United States Patent [19]

Butler

[11] 3,934,494

[45] Jan. 27, 1976

[54] POWER VENTILATOR

[76] Inventor: Henry N. Butler, Highway 180 East, Rte. 3, Box 3, Mineral Wells, Tex. 76067

[22] Filed: Mar. 22, 1974

[21] Appl. No.: 454,005

Related U.S. Application Data

[62] Division of Ser. No. 335,073, Feb. 23, 1973, Pat. No. 3,862,218.

[52] U.S. Cl. ..... 98/43; 52/63

[51] Int. Cl.[2] ..... F24F 7/02

[58] Field of Search ..... 98/43, 61, 81, 42; 52/63, 52/200

[56] References Cited

UNITED STATES PATENTS

| | | | |
|---|---|---|---|
| 2,635,302 | 4/1953 | Denning | 52/63 |
| 2,926,837 | 3/1960 | Coe | 98/43 |
| 3,683,427 | 8/1972 | Burkholz | 52/82 |
| 3,788,335 | 11/1974 | Hemmelsbach | 52/63 X |

*Primary Examiner*—William E. Wayner
*Attorney, Agent, or Firm*—Richards, Harris and Medlock

[57] ABSTRACT

Disclosed is a power ventilator attached to a roof for ventilating an attic or the like. The power ventilator is provided with a base which attaches to the roof adjacent an opening in the roof. The base has a hollow cylindrical housing which forms an air duct. A plurality of wire supports are used to attach a generally dome-shaped cover and an electrically powered fan and motor to the cylindrical flange. Each wire support has a curved portion which conforms with and contacts an arcuate portion of the cover. Each wire bracket has a flange which extends into the interior of the cylindrical flanged portion to support the fan motor. A screen is attached across the opening between the cover and the cylindrical flanged portion. A thermostat means is connected to the exhaust fan to operate the fan when the temperature in the attic exceeds a first predetermined temperature and disengages the fan when the temperature falls below a second predetermined temperature. A fire prevention means is provided to disengage the fan when the temperature in the attic exceeds a third predetermined temperature and engages the fan when the temperature falls below a fourth predetermined temperature.

1 Claim, 5 Drawing Figures

POWER VENTILATOR

This is a division of application Ser. No. 335,073, now U.S. Pat. No. 3,862,218, filed Feb. 23, 1973.

The present invention relates to a ventilator for ventilating a space such as an attic, or the like, and more particularly to an improved power ventilator which is thermostatically controlled.

In the cooling of buildings in warmer climates, it has been a common practice to provide ventilators in the roof or upper portion of the structures to allow the escape of hot air therefrom. This escape of hot air from the building provides a circulation which reduces the temperature therein.

In some situations where the natural circulation through the ventilator does not provide adequate cooling of the structure, it is desirable to place a fan or blower to assist in the circulation of air through the ventilator. To prevent the necessity of operating the fan or blower continuously, it is desirable to attach a thermostat to the fan or blower to selectively engage the fan or blower during portions of the day when the additional circulation is required. These thermostats increase the efficiency of the system, and are normally operable when the temperature in the structure exceeds a first predetermined temperature. Since thermostats engage the fan when the temperature in the structure exceeds a first set minimum, the existence of a fire in the structure would cause a thermostat to operate the fan or blower. This operation of the fan would produce an undesirable result, in that, the increased circulation of air through the structure would tend to cause the fire to spread at a faster rate, increasing property damage and risk of injury by the fire.

The general purpose of the present invention is to provide an improved thermostatically controlled power ventilator which eliminates the adverse effect of the ventilator in the presence of a fire. To attain this, the present invention contemplates the use of an improved ventilator structure with a unique control means which will engage the fan or blower when the temperature in the structure exceeds a first set minimum, but will disengage the blower when fire is present in the structure.

OBJECTS OF THE INVENTION

It is therefore, a primary object of the present invention to provide an improved power ventilator.

Another object of the present invention is the provision of an improved power ventilator with a fire sensing safety shut off.

A further object of the present invention is the provision of an improved power ventilator with improved strength.

Still another object of the present invention is the provision of an improved power ventilator which is simple and inexpensive to manufacture and install.

Other objects and many of the attendant advantages of the present invention will be readily appreciated by those of ordinary skill in the art as the same becomes better understood by reference to the following Detailed Description, when considered in connection with the accompanying Drawings in which:

DESCRIPTION OF THE PREFERRED EMBODIMENT

Figure 1:
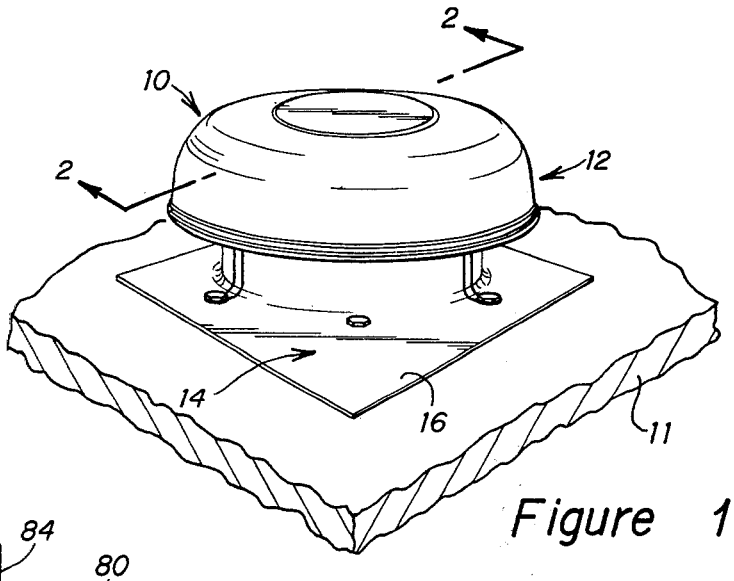
FIG. 1 illustrates a perspective view of the improved power ventilator of the present invention.

Referring now to the Drawings, wherein like reference characters designate like or corresponding parts throughout the several views, there is shown in FIG. 1 a power ventilator which for purposes of description, is identified by reference numeral 10.

The power ventilator 10 is of the type which is mounted over an opening in the roof 11 of a building, or the like to force air to flow from the inside to the outside of the building. The power ventilator 10 is of the type which utilizes an electrically powered fan which is selectively controlled to force air to flow through the opening in the roof and out of the ventilator.

The power ventilator 10 has a generally dome-shaped cover assembly 12, which protects the interior of ventilator 10 from exposure to weather when the ventilator 10 is mounted on a roof 11. The ventilator 10 is illustrated as being attached to a flat roof 11, but it should be understood that the ventilator could be attached to inclined roof surfaces. The cover assembly 12 is attached to the housing assembly 14, which is in turn attached to a roof. The details of the construction of the housing assembly 14 will be described hereinafter and it is only important to note at this point that the housing assembly 14 is provided with a square flange 16, which is designed to lay flush on a roof surface to attach and support the power ventilator 10 in place.

Figure 2:
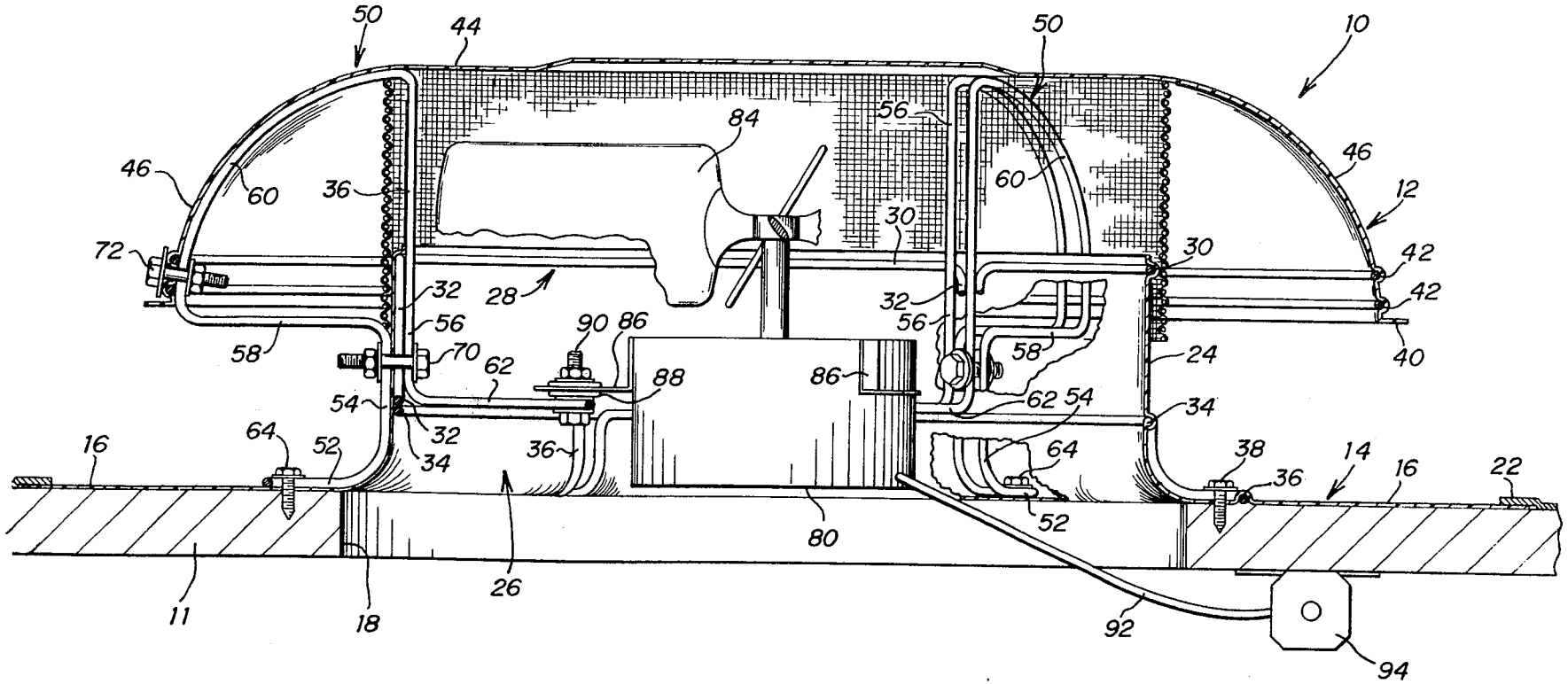
FIG. 2 is an enlarged partial section of the power ventilator taken on line 2—2 of FIG. 1, looking in the direction of the arrows.

In FIG. 2, the power ventilator 10 is illustrated in vertical section attached in position over a circular opening 18 in the roof 11. As previously described, the flange 16 is attached flush on the roof and can have the shingles 22 overlapping the flange 16 to assist in sealing the power ventilator 10 against the weather. The flange 16 has a cylindrical portion 24, which extends transverse to the plane of the flange 16. The interior of this cylindrical portion 24 forms an air duct 26, which is aligned with opening 18 in the roof 11.

Figure 3:
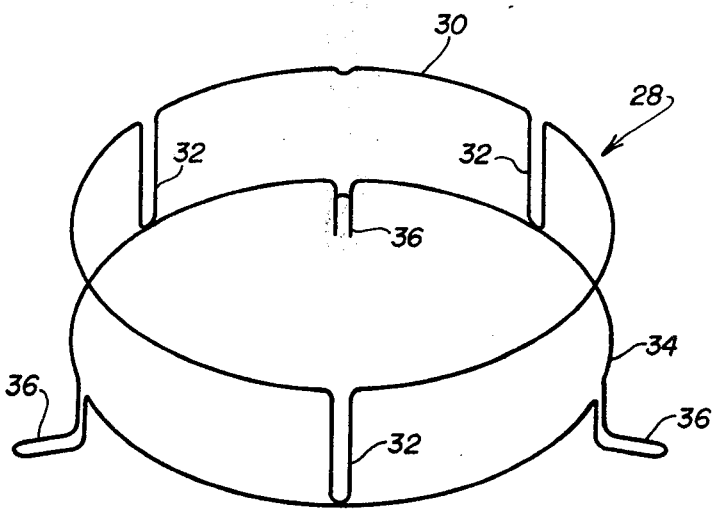
FIG. 3 illustrates a perspective view of the wire structure used in the construction of the housing.

The housing assembly 14 is constructed from a sheet of polyethylene material 27, which is heat-shrunk onto a wire frame assembly 28. This wire frame assembly 28 is formed from galvanized steel material and is illustrated in detail in FIG. 3. This frame assembly 28 has a first wire ring 30 with three downwardly extending connecting loops 32 integrally formed thereon. These three connecting loops 32 are attached as by welding to a second wire ring 34, which has three outwardly extending feet 36. As can be seen in FIG. 2, these feet 36 extend under the flange 16, and can be used to anchor the power ventilator assembly 10 to the roof 11 by means of screws 38. In addition, the flange 16 may be attached to the roof by conventional roofing nails, or the like.

The cover assembly 12 is also formed from polyethylene material 40, which is heat shrunk onto a wire frame. This wire frame consists of a pair of parallel spaced galvanized steel wire rings 42, which extend around the periphery of the cover. The polyethylene material 40 is formed with a flat top portion 44 and an arcuate portion 46, extending around the edge thereof.

Figure 4:
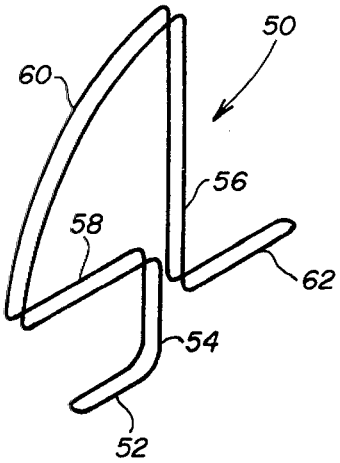
FIG. 4 illustrates a perspective view of the wire bracket used to attach the cover to the housing.

The cover assembly 12 is attached to the housing assembly 14 by means of a plurality of attachment brackets 50, which are shown in detail in FIG. 4. The support bracket 50 is formed from a length of galvanized steel material with the ends welded together to form a continuous structure as shown in FIG. 4. More particularly, each of the support brackets 50 have a foot 52, which is formed by two parallel extending portions of wire. Extending transverse to the foot 52 is a portion 54. This portion 54 cooperates with the parallel extending portion 56 for use in attaching the support bracket 50 to the housing assembly 14, as will be hereinafter described in detail. Extending transverse to the portion 54, is a portion 58. An arcuate portion 60 connects the portions 56 and 58 and has a shape which generally conforms with the interior of the arcuate portion 46 of the polyethylene material 40 of the cover assembly 12. A motor support portion 62 extends from the portion 56 in a direction transverse to the length thereof.

Three support brackets 50 are used to attract the cover assembly 12 to the housing assembly 14. These support brackets 50 are circumferentially spaced around the housing and two of said support brackets 50 are illustrated in FIG. 2, it being understood, of course, that the third bracket is not shown due to the fact that FIG. 2 is a sectional view. It is apparent that more brackets 50 could be used if necessary for the particular size and shape of the ventilator 10.

The support brackets 50 are aligned on the housing assembly 14 with the portions 54 and 56 adjacent to the portions 32 of the frame 28. A nut and bolt assembly 70 is inserted through the space between the wires forming the portions 32, 54 and 56 to rigidly attach the support brackets 50 to the housing assembly 14. If desired, a screw 64 similar to screw 38 may be inserted through the foot 52 to further rigidly attach the support bracket 50 in place. Nut and bolt assemblies 72 are likewise inserted through the space formed between the two wire rings 42 and the space formed between the wires forming the arcuate portion 60. In this manner, the cover assembly 12 is rigidly attached to the support brackets 50 to hold the same in place. By attaching the cover in this manner, additional strength to resist environmental loading can be obtained while using a relatively thin polyethelene material.

A conventional electric motor 80 with a fan blade assembly 84 attached to the output shaft 82 is positioned in the air duct 26 to cause air to flow therethrough. The housing of the motor 80 is provided with three circumferentially spaced flanges 86, which are spaced 120° apart and align with the motor support portions 62 of the support brackets 50. These flanges 86 are suitably attached by means of rubber bushings 88 and nut and bolt assemblies 90 to the motor support portion 62.

The electric motor 80 has a power cable 92 which extends to a control means 94. This control means 94 is mounted on the interior of the roof 11 in a position adjacent to the power ventilator 10. The control means 94 is also connected to a power supply such as 110 volts AC power by means of a power cable not shown.

Figure 5:
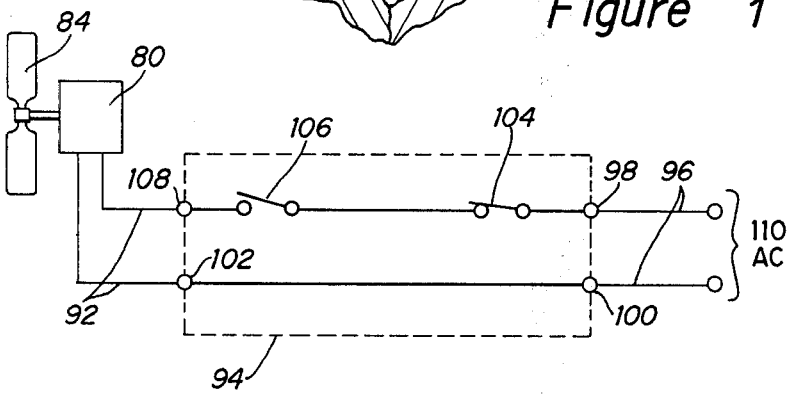
FIG. 5 is a schematic wiring diagram for the power ventilator.

A schematic wiring diagram of the control means 94 is illustrated in FIG. 5. This control means 94 is supplied with 110 AC power through lines 96 to input terminals 98 and 100. The input terminal 100 is in turn connected to output terminal 102, which is in turn connected to the motor 80 through power cable 92. The terminal 98 is connected in series with switches 104 and 106 to an output terminal 108. This output terminal 108 is in turn connected through power cable 92 to motor 80. The switch 104 is normally closed, whereas the switch 106 is normally open. Switch 106 is a thermostatically-controlled switch which is set to close when the temperature adjacent to the control means 94 exceeds 110°F., and will open when the temperature falls below 96°F. This switch can be any thermostatic switch which is commercially available such as those having part no. 40T1, manufactured by Therm-O-Disc Inc., Mansfield, Ohio. The control means 94 will energize the fan motor 80 when the temperature at the control means 94 exceeds 110°F. and will disconnect the fan motor 80 when the temperature falls below 96°F.

Connected in series with thermostatic switch 106 is a fire control switch 104. This fire control switch 104 is normally closed and is set to open when the temperature adjacent the control means 94 exceeds a third set temperature of 350°F. This switch will remain open until the temperature falls below a fourth set temperature of 125°F. A typical example of this type of switch is 60T11, manufactured by Therm-O-Disc Inc., Mansfield, Ohio. Thus it can be seen that an excessive temperature such as those present during the presence of a fire in the area to be ventilated will open switch 104 and override the operation of the thermostatic switch 106 to disconnect the fan motor 80. In this manner, the fire control or protection aspect of the control mmeans 94 reduces the adverse effects of a thermostatically controlled power ventilator in the presence of fire.

It is to be understood that the switch 104 could be of the type which locks in the open position and requires a manual reset to allow the fan to operate.

It should be understood, of course, that the foregoing disclosure relates to only a preferred embodiment of the invention, and that numerous modifications or alterations may be made therein by those of ordinary skill in the art without departing from the spirit and the scope of the invention as set forth in the appended claims.

I claim:

1. A ventilator for installation on horizontal and inclined surfaces of roofs having an opening connected with a space to be ventilated, comprising:

a hollow support base with the interior of said base, communicating with said opening, said support base having a first square-shaped flanged portion resting on the surface of said roof, a second cylindrical flanged portion extending transverse to the plane of said first flange, said first and second flanges being constructed from flexible material, a rigid frame reinforcing said first and second flange, a plurality of rigid feet extending from said frame, said rigid feet being attached to said roof;

a generally dome-shaped cover for said support base, said dome-shaped cover having arcuate portions adjacent the periphery thereof, said cover being formed from a flexible material and a rigid frame;

a plurality of bracket means for attaching said cover to said support base, said bracket means having an arcuate portion for contacting the arcuate portion of said cover, said bracket means being attached to the rigid frame of said cover and the rigid frame of said base, rigid feet extending from said bracket means, said rigid feet being attached to the roof, a fan support flange extending from one end of each of said bracket means into the interior of said cylindrical flange of said base;

a fan attached to said fan support flanges of said bracket means and the interior of said cylindrical flange causing air to flow from said base through said ventilator; and screen means extending across the opening between said cover and said base for preventing undesirable objects from entering said ventilator.

* * * * *

· UNITED STATES PATENT OFFICE

CERTIFICATE OF CORRECTION

Patent No. 3,934,494 Dated January 27, 1976

Inventor(s) HENRY N. BUTLER

It is certified that error appears in the above-identified patent and that said Letters Patent are hereby corrected as shown below:

Col. 1, line 2, change "Pat. No. 3,862,218" to --Pat. No. 3,862,718--.

Col. 4, line 11, after "exceeds" insert --a first set temperature of--.

Col. 4, line 12, after "below" insert --a second set temperature of--.

Col. 4, line 33, "mmeans" should be spelled --means--.

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*